US007490376B2

(12) United States Patent
McMullen

(10) Patent No.: US 7,490,376 B2
(45) Date of Patent: Feb. 17, 2009

(54) DRAIN OUTLET WITH INTEGRAL CLAMP FOR USE WITH A PLUMBING FIXTURE

(75) Inventor: Mark F. McMullen, Adell, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 11/787,895

(22) Filed: Apr. 18, 2007

(65) Prior Publication Data

US 2007/0245485 A1 Oct. 25, 2007

Related U.S. Application Data

(60) Provisional application No. 60/793,687, filed on Apr. 20, 2006.

(51) Int. Cl.
*E03C 1/182* (2006.01)

(52) U.S. Cl. ..... 4/653; 4/679; 4/286

(58) Field of Classification Search ..... 4/252.1, 4/285–286, 288, 619, 643, 650–652, 679–680, 4/695, 538, 262, 263, 646, 653, 287, 417, 4/418, 613, 649; 285/139.1, 139.2, 192, 285/193, 206, 208, 58, 59, 205
See application file for complete search history.

(56) References Cited

U.S. PATENT DOCUMENTS

| | | | | | |
|---|---|---|---|---|---|
| 95,542 | A | * | 10/1869 | Walton | 4/679 |
| 328,354 | A | * | 10/1885 | Stears | 4/689 |
| 535,139 | A | * | 3/1895 | Kelly | 4/252.1 |
| 765,131 | A | * | 7/1904 | Croswell | 4/652 |
| 1,067,533 | A | * | 7/1913 | Mann | 4/252.1 |
| 1,224,297 | A | * | 5/1917 | Glauber | 285/139.1 |
| 1,236,450 | A | * | 8/1917 | Kohler | 4/288 |
| 1,326,626 | A | | 12/1919 | Wolfe | |
| 1,497,398 | A | | 6/1924 | Axelson et al. | |
| 1,587,967 | A | * | 6/1926 | Limont | 285/390 |
| 2,419,453 | A | | 4/1947 | Kocevar | |
| D170,530 | S | | 10/1953 | Hendrickson | |

(Continued)

FOREIGN PATENT DOCUMENTS

| | | |
|---|---|---|
| GB | 169520 | 9/1921 |

(Continued)

OTHER PUBLICATIONS

PCT International Search Report, Form PCT/ISA/210, 5 pages.

*Primary Examiner*—Robert M Fetsuga
(74) *Attorney, Agent, or Firm*—Quarles & Brady LLP

(57) ABSTRACT

A drain tube assembly for use with a lavatory or other plumbing fixture is disclosed. The lavatory has a basin, a lower drain outlet having an internal threaded bore, and a one-piece drain structure having a drain tube adjacent one axial end, an attachment sleeve adjacent an opposed axial end which is radially outwardly threaded, and a radially extending flange there between. When attached, the drain structure has an axial path extending through the attachment sleeve, flange, and drain tube to carry liquid from the lavatory out the drain tube. In a first position the flange can form a clamp member if the assembly is to be mounted through a counter top. Alternatively the flange can in a second position form a base for the lavatory when the lavatory is suspended. Movement between the positions is created by varied degrees of threading the sleeve into the lower drain.

4 Claims, 2 Drawing Sheets

U.S. PATENT DOCUMENTS

| | | | | |
|---|---|---|---|---|
| 3,105,707 | A | 10/1963 | Jacobson | |
| 3,231,903 | A | 2/1966 | Cope | |
| 3,408,092 | A | 10/1968 | Appleton | |
| 3,465,372 | A * | 9/1969 | Reagan | 4/287 X |
| 4,730,854 | A | 3/1988 | Cuschera | |
| 5,456,499 | A | 10/1995 | Sharpe | |
| 6,367,102 | B1 | 4/2002 | McMullen | |
| 6,553,583 | B1 | 4/2003 | Pan | |
| 6,763,533 | B2 * | 7/2004 | Mayer et al. | 4/650 |
| D498,292 | S | 11/2004 | Piatt | |
| D498,522 | S | 11/2004 | Lanius | |
| 2004/0117907 | A1 | 6/2004 | Ball | |
| 2006/0064809 | A1 * | 3/2006 | Isgro | 4/288 |

FOREIGN PATENT DOCUMENTS

| | | |
|---|---|---|
| GB | 514246 | 11/1939 |
| GB | 1422268 | 1/1976 |

* cited by examiner

DRAIN OUTLET WITH INTEGRAL CLAMP FOR USE WITH A PLUMBING FIXTURE

CROSS-REFERENCE TO RELATED APPLICATION

This application claims priority of provisional application 60/793,687 dated Apr. 20, 2006.

STATEMENT OF FEDERALLY SPONSORED RESEARCH OR DEVELOPMENT

Not applicable.

BACKGROUND OF THE INVENTION

The present invention relates to lavatories and other plumbing fixtures which have a drain outlet. It particularly relates to an attachable drain with an integral clamping flange that can be adjustably fixed to the plumbing fixture to facilitate varied types of installations.

U.S. Pat. No. 6,367,102 shows a prior art type of lavatory installation where there is a drain hole through the bottom of the lavatory basin. In this assembly a drain flange is positioned in the basin around the drain hole and also partially in the drain hole. The flange has a lower threaded end.

That lower end is then linked below the counter top to a drain tube which, in the case of this patent, has an integral clamping flange. Tightening the drain tube onto the lower end of the drain flange clamps the drain flange against the bottom of the lavatory or sink.

In other installations, there is no integral clamping flange. Instead, a clamping nut is threaded upward along the drain tube until it performs the clamping function.

In any event these designs leave an exposed, typically metal, drain flange visible to the user. Further, they require several parts to be linked together to complete the overall assembly.

This has a number of disadvantages. For one thing, the drain flange disrupts the ornamentation on the surface of the lavatory if the lavatory surface has been ornamented. For another, the point at which the edge of the flange contacts the lavatory basin top surface is a location which can be somewhat difficult to completely clean. In any event, the connection between the flange and lavatory needs to be sealed. Further, the greater number of parts required, the greater the manufacturing cost, and the greater the cost of assembly if a plumber is hired to make the assembly.

There have also been developed a variety of lavatories whose main basin sits completely over a counter top. See e.g. the "Conical Bell Vessels" and "Vessels Turnings" lavatories of Kohler Co. Attachment structures suitable for linking these lavatories to waste systems have typically had quite different structures from those used to mount designs where the basin of the lavatory is below the counter top to some extent.

Hence, a need exists for improved drain mounting assemblies for plumbing fixtures such as lavatories, particularly where the lavatories may sometimes be mounted by a clamping system, and other times be mounted in other ways.

SUMMARY OF THE INVENTION

In one aspect the present invention provides a drain assembly suitable for attachment to an outlet 11 of a plumbing fixture. The assembly has a one-piece drain structure having a drain tube adjacent one axial end, an attachment sleeve 23 adjacent an opposed axial end which is radially outwardly threaded, and a radially extending flange 22 there between. The drain structure has an axial bore 27 extending through the attachment sleeve, flange and drain tube so as to be able to carry liquid from the plumbing fixture out an outlet 25 of the drain tube if the drain structure is attached to the outlet and liquid is passed through the plumbing fixture outlet.

In preferred forms the plumbing fixture is a lavatory, the radially extending flange 22 extends radially outward farther than the attachment sleeve 23 does, and the drain assembly is entirely made of metal. Also, the drain tube may have a flat outer side wall portion suitable for facilitating the use of a tool to rotate the drain tube along its axis.

In another aspect the invention provides a combined lavatory and drain tube assembly. There is a lavatory having a basin 26 and a lower drain outlet. The outlet has an internal axially extending threaded bore that extends from the basin.

There is also a one-piece drain structure having a drain tube adjacent one axial end, an attachment sleeve adjacent an opposed axial end which is radially outwardly threaded, and a radially extending flange there between. The drain structure has an axial path 28 extending through the attachment sleeve, flange and drain tube so as to be able to carry liquid from the basin of the lavatory out the drain tube if the drain structure is threaded to the outlet and liquid is passed through the outlet.

In a first position the flange can form a clamp member if the assembly is mounted through a counter top. In a second position different from the first position the flange can form a base 29 for the lavatory (preferably one that smoothly melds ornamentally with the sides of the outlet). The first and second positions are achieved by varied degrees of threading the attachment sleeve into the outlet internal threaded bore.

It will be appreciated from the description below that the present invention permits a single assembly structure of only two parts to fasten the drain to the plumbing fixture while also providing the option of an axially adjustable clamping member. When a clamping installation is not required the same parts can be further threaded together so as to provide an ornamentally acceptable base for the pedestal.

The present invention is inexpensive to manufacture, and can be assembled quite quickly. Further, it is intuitive in its nature, making it suitable for use by those without formal plumbing training.

Importantly, no drain flange is required on the visible portion of the lavatory basin. As a result, apart from the ornamental improvement which results, the design also does not require an additional sealing step along the top surface of the lavatory basin. Further, the basin is somewhat easier to clean.

These and still other advantages of the present invention will be apparent from the detailed description and drawings. What follows are merely preferred embodiments of the present invention. To assess the full scope of the invention the claims should be looked to.

DETAILED DESCRIPTION OF THE PREFERRED EMBODIMENTS

Figure 1:
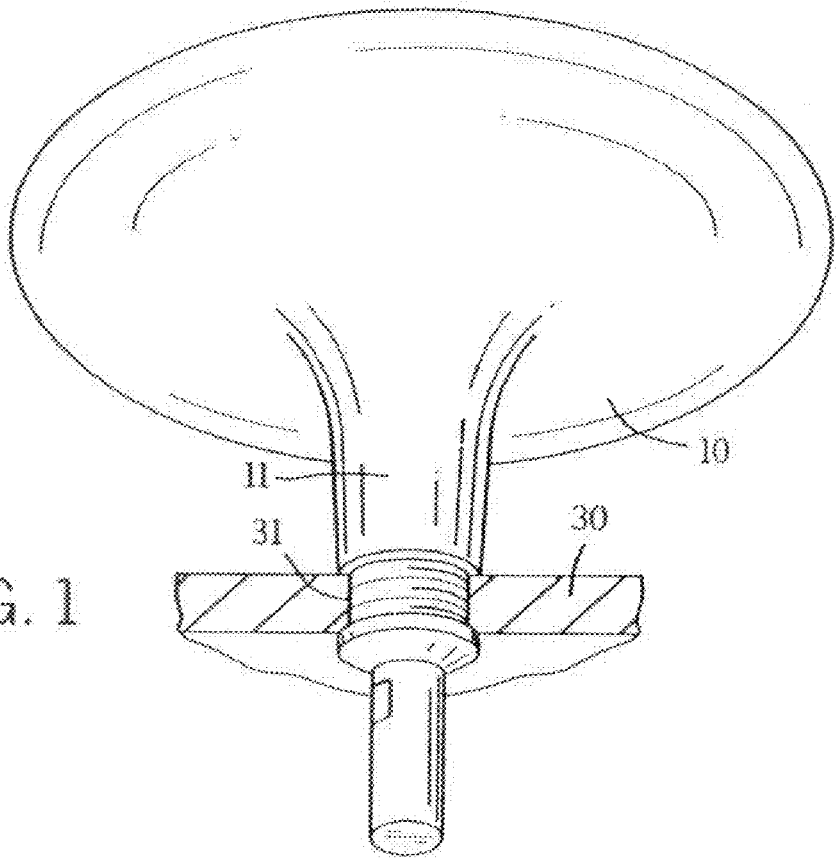
FIG. 1 is a lower perspective view of an embodiment of the present invention, shown mounted through a counter top.
Figure 2:
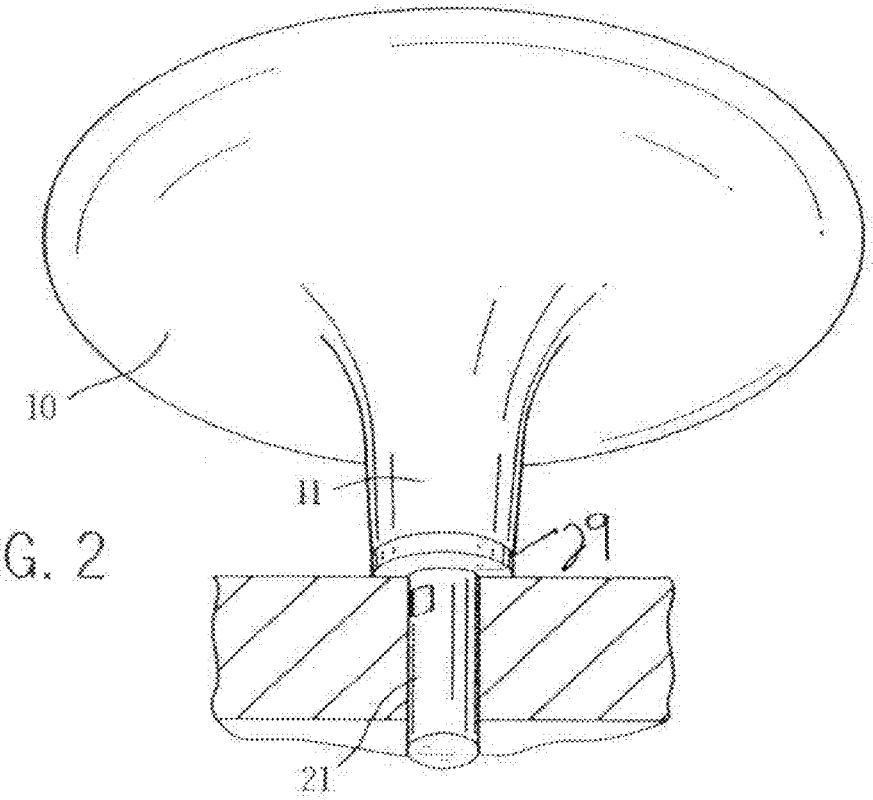
FIG. 2 is another lower perspective view thereof, but showing the embodiment mounted on a pedestal.

Referring first to FIGS. 1 and 2, there is shown a lavatory 10 having a lower drain outlet portion 11. That lower portion 11 is provided with a cylindrical vertical drain bore 12 which is internally threaded at 14. The entire lavatory 10 can be an integral one-piece structure made of a machinable metal such as brass. There is no need for a drain flange that is visible from the top of the design one the lavatory is installed.

Figure 3:
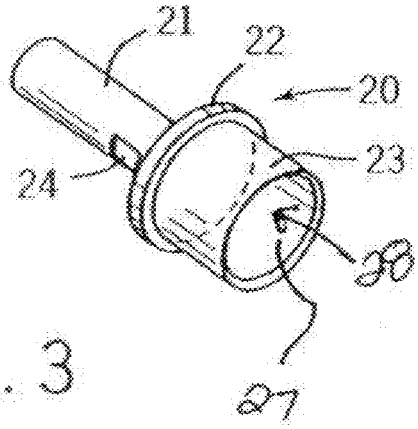
FIG. 3 is a perspective view showing an integrated outlet and clamping structure which forms part of the preferred embodiment.
Figure 4:
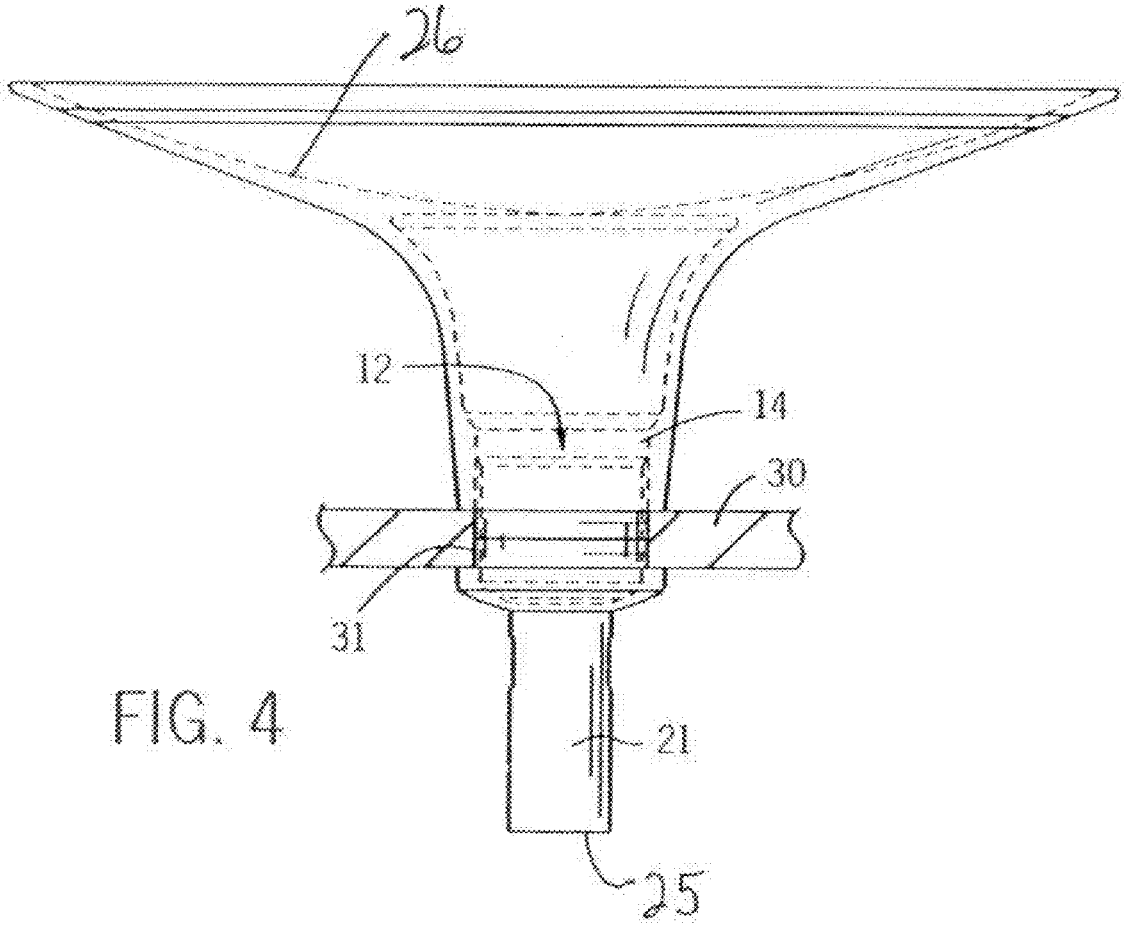
FIG. 4 is a vertical cross sectional view through the FIG. 1 assembly.

FIG. 3 depicts a drain structure 20 having a drain tube portion 21, a clamping flange 22 and an outwardly threaded enlarged tubular portion 23. There is also a flat 24.

When the lavatory 10 is to be mounted in a clamping installation like that of FIG. 1, the lavatory 10 can be positioned on a counter top 30 or the like having a through bore 31. The threaded portion 23 of the drain structure 20 can then be partially threaded into the threads 14 until the flange 22 abuts under the counter top 30 to affix/clamp the lavatory in place.

If desired standard clamping gaskets can be used above and below the counter top in a standard fashion. However, standard plumber's putty could by itself suffice to seal the bore 31.

It should be appreciated that the present invention achieves both the attachment of the drain tube, and the clamping of the lavatory in place (when clamping is needed), in a single step. The flat 24 facilitates the use of a wrench or other means to tighten the interthreading of the threads of portion 23 with the internal threads 14 of the portion 11.

As best seen in FIG. 2, when a pedestal type of installation is desired, the drain structure 20 can be completely threaded into the bore of portion 11, thereby attaching the drain structure without the need for its clamping function. By threading the structure all the way in the assembly becomes quite compact, and the edge of the portion 11 smoothly melds with the edge of flange 22. Thus, the junction can be visible without significantly degrading the ornamental appearance.

It should thus be appreciated that the present invention provides a way to attach a drain tube to a lavatory or other plumbing fixture which avoids the need for a visible drain flange. While the present invention is initially intended for use with lavatories made of metal (e.g. bronze), as these accept threads, lavatories made of other materials (e.g. ceramics) can use the principles of the present invention as well. Of course, for them it may be desirable to create an insert piece made of metal that goes into the bore of the outlet so that the thread to thread interaction will still be entirely between metal parts.

It should be noted that identical parts create an assembly suitable for use both in a clamping installation as well as in a pedestal installation. Further, the drain tube can be optimized to further facilitate installation (e.g. a flat provided to permit easier gripping by an appropriate wrench or other tool).

Because the assembly is comprised of so few parts, it is inexpensive to produce, and takes less time to assemble than some prior art designs. Further, the assembly avoids any concern about sealing or dirt collection at a joint between a visible drain flange and the lavatory.

It should be appreciated that a preferred embodiment of the invention has been described above and depicted in the enclosed drawings. However, many modifications and variations to the preferred embodiments will be apparent to those skilled in the art, which will be within the spirit and scope of the invention. For example, while the invention has been depicted in the context of a lavatory, it will also have applicability for other plumbing fixtures having attachable drains (e.g. toilet tanks).

Therefore, the invention should not be limited to just the described embodiments. To ascertain the full scope of the invention, the following claims should be referenced.

INDUSTRIAL APPLICABILITY

The invention provides assemblies for attaching drains with clamping capability to a plumbing fixture having an outlet.

I claim:

1. A combined lavatory, counter top, and drain tube assembly, comprising:

a counter top having a through bore;

a lavatory having a basin and a lower drain outlet, wherein said outlet has an internal axially extending threaded bore that extends from the basin; and a one-piece drain structure extending into the through bore and having a drain tube adjacent one axial end, an attachment sleeve adjacent an opposed axial end which is radially outwardly threaded and a radially extending flange there between, wherein the radially extending flange extends radially outward farther than the attachment sleeve does; and wherein the drain structure is threaded to the lavatory drain outlet and has an axial path extending through the attachment sleeve, flange and drain tube so as to be able to carry liquid from the basin of the lavatory out the drain tube if liquid is passed through the lavatory drain outlet; and wherein the radially extending flange forms a base for the lavatory with the base being positioned above the counter top and the lavatory drain outlet being positioned on the base.

2. The assembly of claim 1, wherein the drain structure is entirely made of metal.

3. The assembly of claim 1, wherein the drain tube has a flat outer side wall portion suitable for facilitating the use of a tool to rotate the drain tube along its axis.

4. A combined lavatory, counter top, and drain tube assembly, comprising:

a counter top having a through bore;

a lavatory having a basin and a lower drain outlet, wherein said outlet has an internal axially extending threaded bore that extends from the basin; and a one-piece drain structure extending into the through bore and having a drain tube adjacent one axial end, an attachment sleeve adjacent an opposed axial end which is radially outwardly threaded and a radially extending flange there between, wherein the radially extending flange extends radially outward farther than the attachment sleeve does; and wherein the drain structure is threaded to the lavatory drain outlet and has an axial path extending through the attachment sleeve, flange and drain tube so as to be able to carry liquid from the basin of the lavatory out the drain tube if liquid is passed through the lavatory drain outlet; and wherein the radially extending flange is positioned under the counter top in a configuration that clamps the lavatory on top of the counter top.

* * * * *